US009332835B2

(12) United States Patent
Shannon

(10) Patent No.: US 9,332,835 B2
(45) Date of Patent: May 10, 2016

(54) PORTABLE DESK

(71) Applicant: John Gregory Shannon, Ocala, FL (US)

(72) Inventor: John Gregory Shannon, Ocala, FL (US)

( * ) Notice: Subject to any disclaimer, the term of this patent is extended or adjusted under 35 U.S.C. 154(b) by 0 days.

(21) Appl. No.: 14/826,284

(22) Filed: Aug. 14, 2015

(65) Prior Publication Data

US 2016/0045022 A1 Feb. 18, 2016

Related U.S. Application Data

(60) Provisional application No. 62/070,049, filed on Aug. 14, 2014.

(51) Int. Cl.

| | |
|---|---|
| ***A47B 23/00*** | (2006.01) |
| ***A47B 3/10*** | (2006.01) |
| ***A47B 13/16*** | (2006.01) |
| ***A47B 13/08*** | (2006.01) |
| ***A47B 13/00*** | (2006.01) |
| ***A47B 3/12*** | (2006.01) |
| ***A45C 5/03*** | (2006.01) |

(52) U.S. Cl.

CPC ... *A47B 3/10* (2013.01); *A45C 5/03* (2013.01); *A47B 3/12* (2013.01); *A47B 13/003* (2013.01); *A47B 13/081* (2013.01); *A47B 13/16* (2013.01); *A47B 23/001* (2013.01)

(58) Field of Classification Search

CPC .... A47B 96/02; A47B 96/027; A47B 96/024; A47B 96/061; A47B 5/02

USPC ..... 108/42, 44, 49, 108, 152; 248/218.4, 248/163.2, 210, 238, 236

See application file for complete search history.

(56) References Cited

U.S. PATENT DOCUMENTS

| | | | | | |
|---|---|---|---|---|---|
| 2,244,861 | A * | 6/1941 | Walker | B43L 3/008 | 108/152 |
| 3,680,235 | A * | 8/1972 | Leemhuis | D06F 81/06 | 108/152 |
| 4,805,867 | A * | 2/1989 | McAllister | B60N 3/005 | 108/44 |
| 4,915,035 | A * | 4/1990 | Clark | B60N 3/005 | 108/44 |
| 5,282,427 | A * | 2/1994 | Steinhilber | A47B 21/03 | 108/152 |
| 5,437,367 | A * | 8/1995 | Martin | A45C 5/14 | 190/107 |
| 5,983,912 | A * | 11/1999 | Leu | A61H 3/02 | 108/152 |
| 6,036,158 | A * | 3/2000 | Raasch | B60N 3/005 | 108/44 |
| 6,240,857 | B1 * | 6/2001 | Elizer | A47B 97/04 | 108/147.17 |
| 6,931,998 | B1 * | 8/2005 | Leese | A47B 5/02 | 108/152 |
| 7,093,545 | B2 * | 8/2006 | Twyford | G06F 3/0202 | 108/44 |
| 7,306,282 | B2 * | 12/2007 | Salzer | A47C 7/70 | 297/145 |
| D575,546 | S * | 8/2008 | Tsay | D14/457 | |
| 7,950,335 | B1 * | 5/2011 | Almond | A47B 23/001 | 108/152 |
| 7,963,231 | B2 * | 6/2011 | Osborne | A47B 5/006 | 108/40 |
| D687,040 | S * | 7/2013 | Meadows | D14/447 | |
| 8,997,660 | B2 * | 4/2015 | Satterfield | B60N 3/001 | 108/44 |
| 2002/0178972 | A1 * | 12/2002 | McNeil | A45C 13/00 | 108/42 |
| 2010/0187063 | A1 * | 7/2010 | Sperry | A45C 13/28 | 190/11 |

* cited by examiner

*Primary Examiner* — Jose V Chen

(74) *Attorney, Agent, or Firm* — Jason T. Daniel, Esq.; Daniel Law Offices, P.A.

(57) ABSTRACT

A portable desk includes a main body having a generally planar top surface, and a plurality of sides. A generally T-shaped engagement member extends linearly from the front side of the main body and is selectively engageable with a pair of parallel rods on a rolling suitcase. The portable desk also includes a cup holder and a hinge for folding the device for storage. The portable desk also includes a second body section positioned beneath the main body. The second body section is resilient and forms a pocket area between the main body and the second body section.

16 Claims, 9 Drawing Sheets

PORTABLE DESK

CROSS-REFERENCE TO RELATED APPLICATIONS

This application claims the benefit of U.S. application Ser. No. 62/070,049 filed on Aug. 14, 2014, the contents of which are incorporated herein by reference.

TECHNICAL FIELD

The present invention relates generally to travel accessories, and more particularly to a portable desk device that is mountable onto a suitcase for use when traveling.

BACKGROUND

The statements in this section merely provide background information related to the present disclosure and may not constitute prior art.

Many individuals throughout this and other countries spend a significant amount of time traveling. To this end, there are times when travelers such as students and business professionals for example, could greatly benefit from having a stable writing surface, as well as a support surface onto which a laptop computer and/or food and beverage items can be placed.

Although there are several known freestanding desks which can be collapsed, none of these devices are practical for use when traveling by air, owing to their size and weight. Moreover, as airlines become increasingly strict regarding carry-on luggage policies, many travelers must be able to fit any such device within the small confines of a carry-on bag.

Accordingly, it would be beneficial to provide a lightweight, inexpensive portable desk which can be utilized in conjunction with a travel suitcase and can be stored within the same when not in use.

SUMMARY OF THE INVENTION

The present invention is directed to a portable desk device for use with rolling bags and other such devices having a pair of parallel handle rods.

One embodiment of the present invention can include a main body having a generally flat upper surface which can act as a writing platform or laptop table. A generally T-shaped engagement member extends outward from the front end of the main body, and forms two pockets. The engagement member can be turned sideways, passed through the parallel rods, and then turned upright, so as to position the rods within the pockets. In the present embodiment, the desk can be suspended from the rods without making contact with the bag itself.

Another embodiment of the present invention can include a drink holder and a hinge which can allow the desk to be folded for easy storage when not in use. Yet another embodiment of the present invention can include a second body section that is positioned beneath the main body. The second body section can be resilient in nature, so as to form a pocket area between the main body and the second body to receive and store documents and other such papers.

This summary is provided merely to introduce certain concepts and not to identify key or essential features of the claimed subject matter.

BRIEF DESCRIPTION OF THE DRAWINGS

Presently preferred embodiments are shown in the drawings. It should be appreciated, however, that the invention is not limited to the precise arrangements and instrumentalities shown.

DETAILED DESCRIPTION OF THE INVENTION

Figure 1:
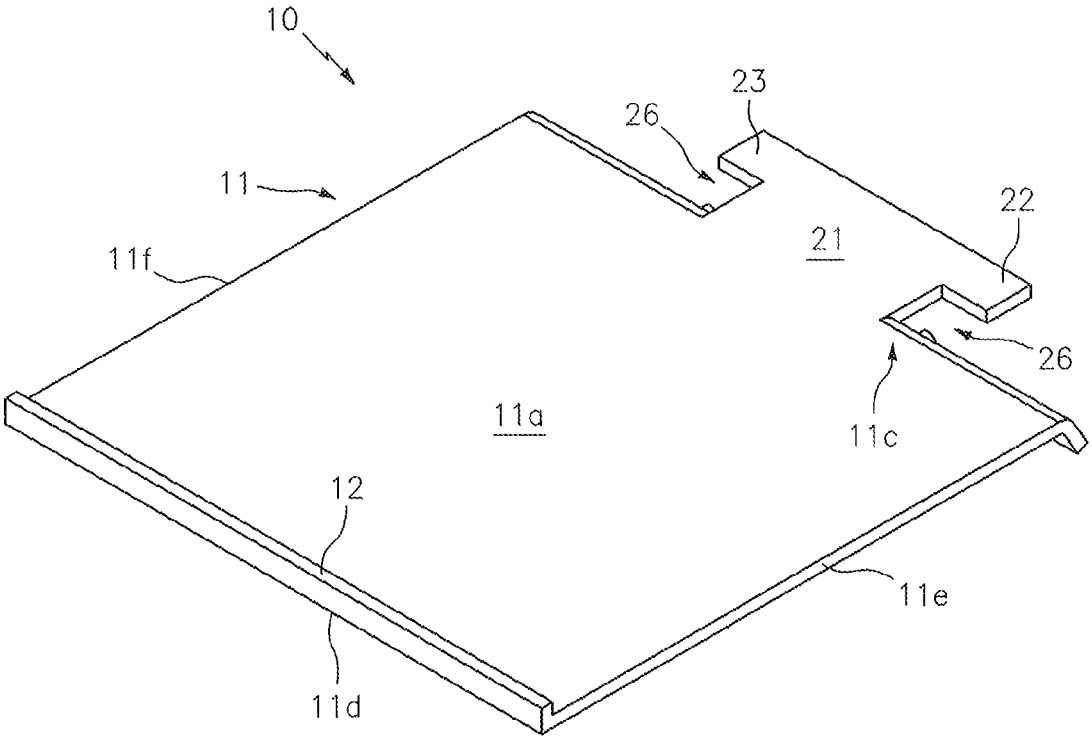
FIG. 1 is a top side view of a portable desk that is useful for understanding the inventive concepts disclosed herein.

While the specification concludes with claims defining the features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention which can be embodied in various forms. Therefore, specific structural and functional details disclosed herein are not to be interpreted as limiting, but merely as a basis for the claims and as a representative basis for teaching one skilled in the art to variously employ the inventive arrangements in virtually any appropriately detailed structure. Further, the terms and phrases used herein are not intended to be limiting but rather to provide an understandable description of the invention.

Although described with reference to a travel device for engaging a suitcase, this is but one possible utilization of the portable desk that is described herein. As such, those of skill in the art will recognize that the desk can be utilized with any number of different devices such as bowling bags, rolling backpacks, collapsible shopping carts, dollies and other such devices that have a pair of longitudinally extended and/or telescoping rods. As such, the desk is not to be construed as limiting to any particular use or industry.

FIGS. 1-5C illustrate various embodiments of a portable desk that are useful for understanding the inventive concepts disclosed herein. Identical reference numerals are used for like elements of the invention or elements of like function. For the sake of clarity, only those reference numerals are shown in the individual figures which are necessary for the description of the respective figure. For purposes of this description, the terms "upper," "bottom," "right," "left," "front," "vertical," "horizontal," and derivatives thereof shall relate to the invention as oriented in FIG. 1.

Figure 2:
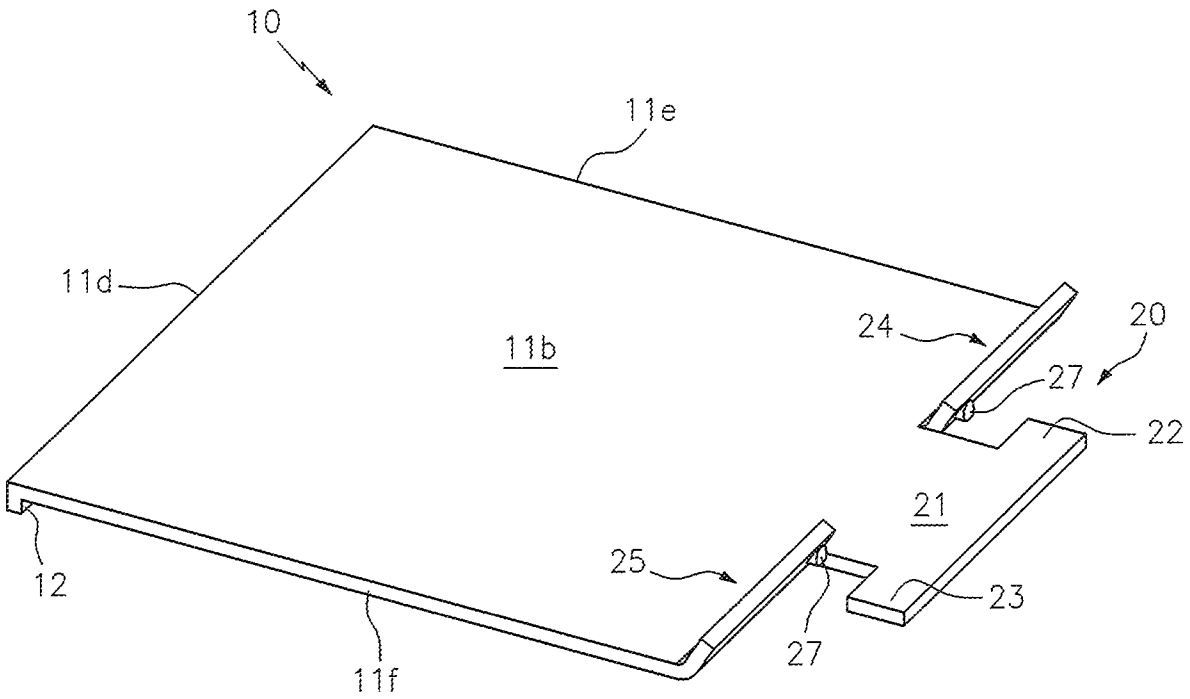
FIG. 2 is a bottom side view of the portable desk, in accordance with one embodiment of the invention.

As shown in FIGS. 1 and 2, one embodiment of a portable desk 10 can include a main body 11 having a generally planar top surface 11*a*, a bottom surface 11*b*, a front end 11*c*, a back end 11*d*, and a pair of opposing sides 11*e* and 11*f*, respectively. A raised lip 12 can extend upward orthogonally from the back end 11*d*, and can function as a barrier for preventing items located on the top surface 11*a* from falling off the desk when being used.

In the preferred embodiment, the main body can be constructed from injection molded plastic and can include a generally rectangular shape. Of course, the desk can also include any number of different shapes, and can be constructed from any number of lightweight durable and/or semi-rigid materials such as wood, polycarbonates and various composites, for example.

As will be described below in detail, the desk 10 is designed to engage the fixed and/or telescoping rods of a suitcase 1 or other such device, in order to allow the desk to be suspended therefrom. In one embodiment, the desk 10 can further include a generally T-shaped engagement member 20 that extends outward linearly from the top end of the main body. As shown, the engagement member can include a central section 21 that is interposed between a pair of perpendicularly-oriented protrusions 22 and 23.

The device can further include a pair of elongated, generally orthogonal walls 24 and 25 that can extend below the bottom surface 11*b*. Each of the walls being positioned along the front end 11*c* from the central section 21 to the opposing sides 11*e* and 11*f*, respectively. In this regard, the protrusions 22 and 23 and the walls 24 and 25 can be arranged parallel to one another, to form pockets 26 that can engage a pair of suitcase rods from the front and back sides.

Additionally, each of the walls 24 and 25 can be provided with one or more non-slip pads 27 to prevent the desk from scratching the telescoping rods, and to increase the coefficient of friction between the same. The pads can be placed along one or both of the protrusions 22-23 and/or the walls 24-25. In the preferred embodiment, the nonstick pads can be constructed from rubber or felt materials that are secured to the walls via an adhesive. Of course, any number of other materials are also contemplated.

Although dimensions are not critical, in one embodiment, the central section 21 of the engagement member 20 can include a width of between approximately 4 and 8 inches, for example. Such a width being complementary to the separation distance between the telescoping rods most commonly utilized in travel suitcases and other such devices. Of course, any number of other widths from which the protrusions 22 and 23 can extend are also contemplated. Likewise, each of the pockets 26 can preferably include a length (measured from the front end of the main body 11*c* to the protrusions 22 and 23) of between approximately 0.25 inches and 2 inches, for example. Such a length being complementary to the thickness of the telescoping rods most commonly utilized in travel suitcases and other such devices. Of course, any number of other lengths are also contemplated.

In either instance, the engagement member will preferably be constructed as a unitary element of the main body, therefore having an identical construction material. Of course, other embodiments are contemplated wherein the engagement member is constructed as a separate element that is permanently or removably affixed to the main body in accordance with known manufacturing techniques. In one such embodiment, the extension member can be secured to the main body via a hinge or other such device that can allow the elements to pivot or move relative to each other.

Figure 3A:
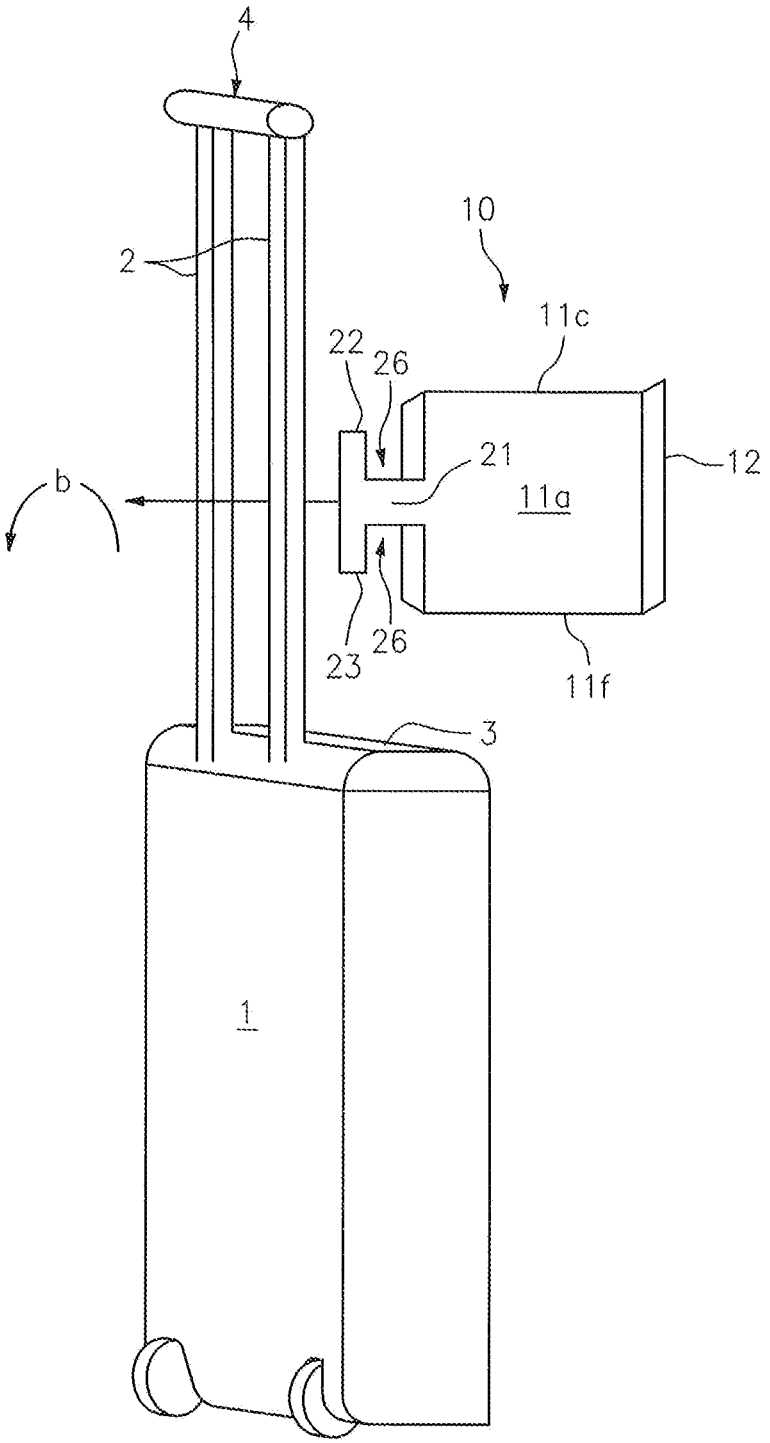
FIG. 3A is a perspective view of the portable desk in operation, in accordance with one embodiment of the invention.
Figure 3B:
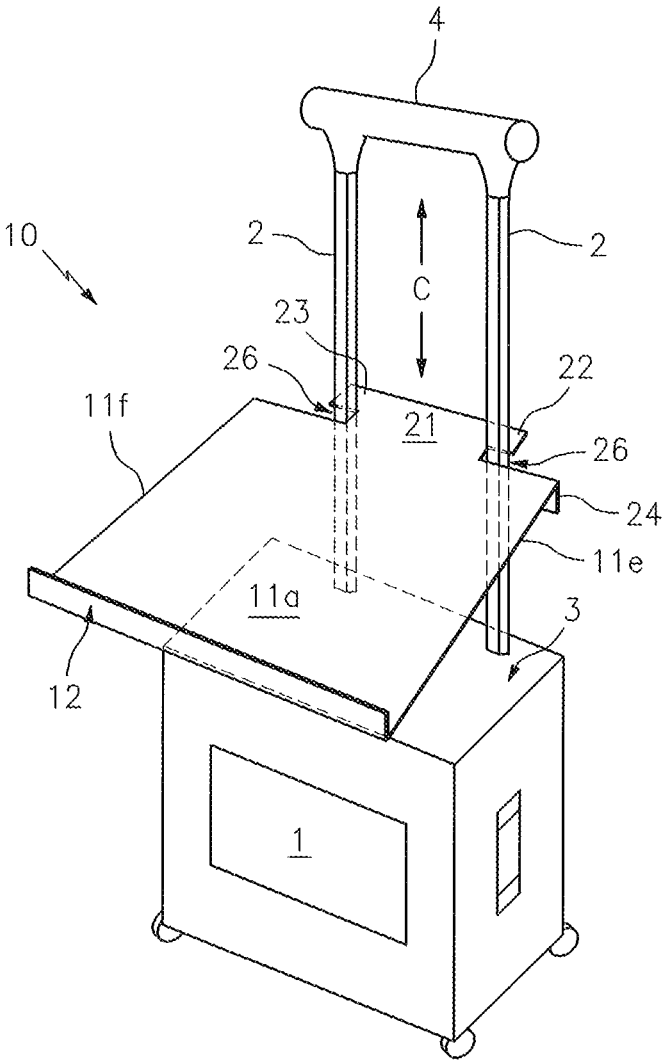
FIG. 3B is another perspective view of the portable desk in operation, in accordance with one embodiment of the invention.

FIGS. 3A and 3B illustrate one embodiment of the portable desk 10 in operation. As shown, the desk 10 can be turned onto its side (e.g., either side 11*e* or 11*f* facing upward) and inserted (see arrow a) between a pair of fixed or telescoping rods 2 that are located on a rolling suitcase 1 or other such device. Once the pockets 26 are aligned with the rods 2, the device can be rotated upright (see arrow b), until the top surface 11*a* is facing upward, and the rods 2 are positioned within the pockets 26 formed by the combination of protrusions 22-23 and walls 24-25, respectively.

As shown, by securing the device along the hard parallel rods 2, the desk 10 does not make contact with the main body of the bag itself. This is advantageous; as such a feature allows the user to adjust the height of the device (see arrow c) along the suitcase anywhere between the top of the bag portion 3 and the handle 4. Moreover, the weight of the device 10, along with the nonslip pads 27 function to prevent the device from slipping when used. To this end, when a user places items onto the top surface 11*a*, the weight is transferred through the frame of the bag to the ground. Such a feature provides a stable fixed platform that does not impart any pressure onto the (typically) soft bag portion 3, or the contents inside.

Figure 4A:
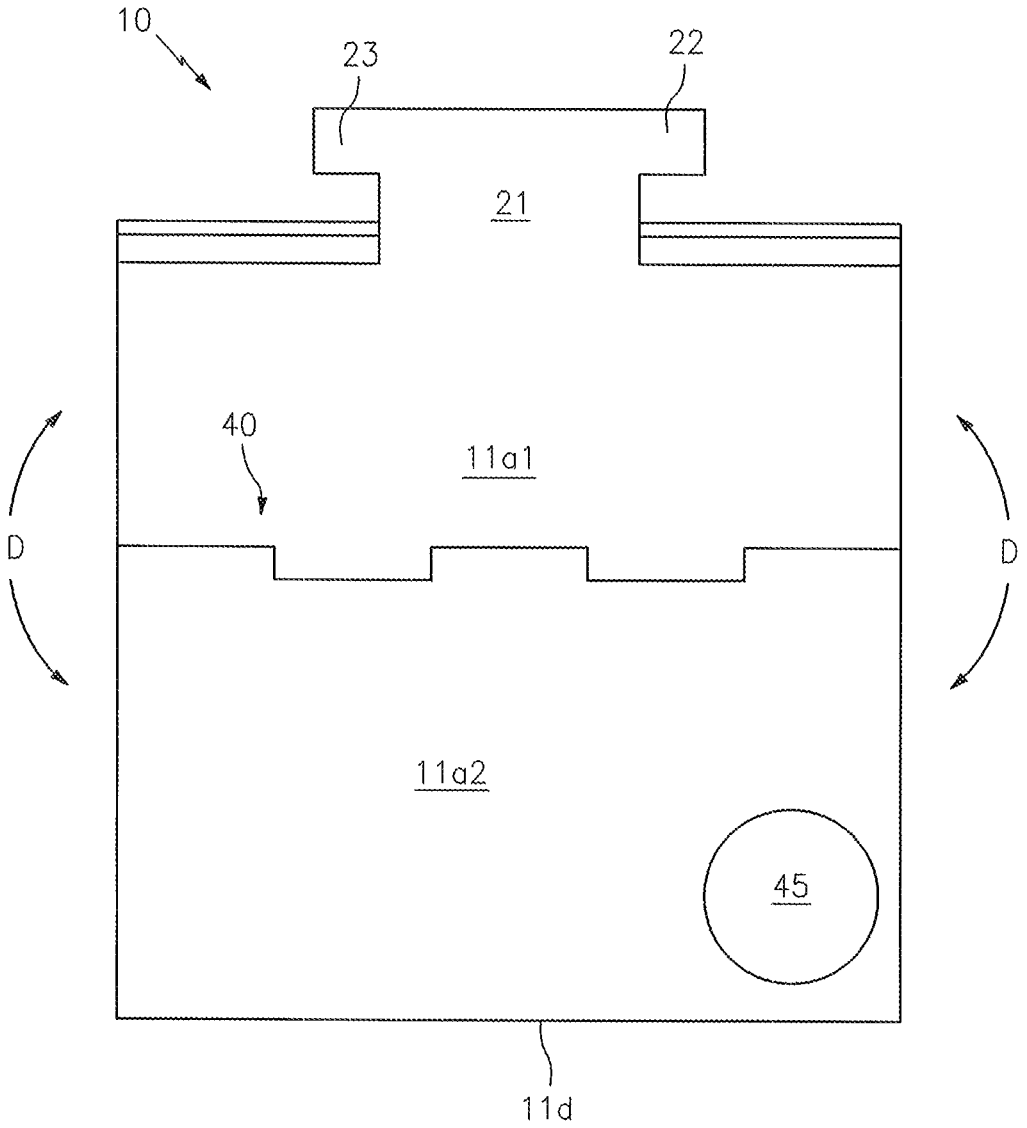
FIG. 4A is a top side view of the portable desk, in accordance with another embodiment of the invention.
Figure 4B:
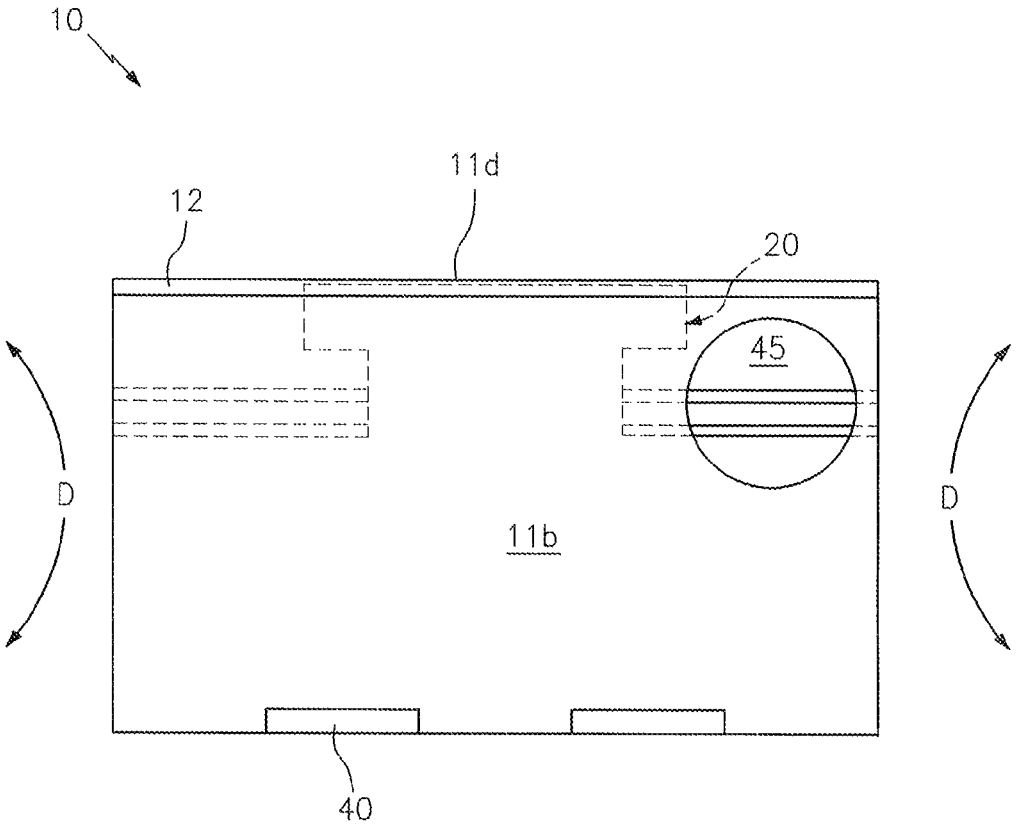
FIG. 4B is another top side view of the portable desk, in accordance with the other embodiment.

FIGS. 4A and 4B illustrate another embodiment of the portable desk 10 that further includes a hinge 40 and an optional aperture 45 which can function as a beverage holder. The hinge can be positioned anywhere along the main body 11, and can function to allow the device 10 to fold (See arrow D) for easy storage within the bag 1 when not in use.

In the present embodiment, the hinge can be positioned mid-way along the length of the main body, and can extend from the opposing sides 11*e* and 11*f*. Such a feature creating two distinct body segments 11*a*1 and 11*a*2 that are separated by the hinge 40. As shown, the aperture 45 is most preferably located adjacent to the bottom end of the device, however, the aperture can be positioned anywhere along the device, and can include any number of different shapes and/or dimensions.

As described herein, the hinge can preferably include a living hinge that is capable of allowing the segments 11*a*1 and/or 11*a*2 to pivot/fold approximately 180 degrees relative to the other surface. Of course, it should be understood that the device is not limited to a living hinge, and that other hinges can be used without departing from the scope of this disclosure. Lightweight hinges that do not create a bulge or other obstruction when the device is in the open/extended position (FIG. 4A) are preferred. While the illustrated hinge is continuous, and disposed along the width of the device (i.e., between the side walls), this is not required in all embodiments, as the hinge mechanism can include one or more separate pieces, and can be mounted along the length of the device as well. Several non-limiting examples of alternative hinges include butt hinges, knife hinges, and piano hinges, for example.

Figure 5A:
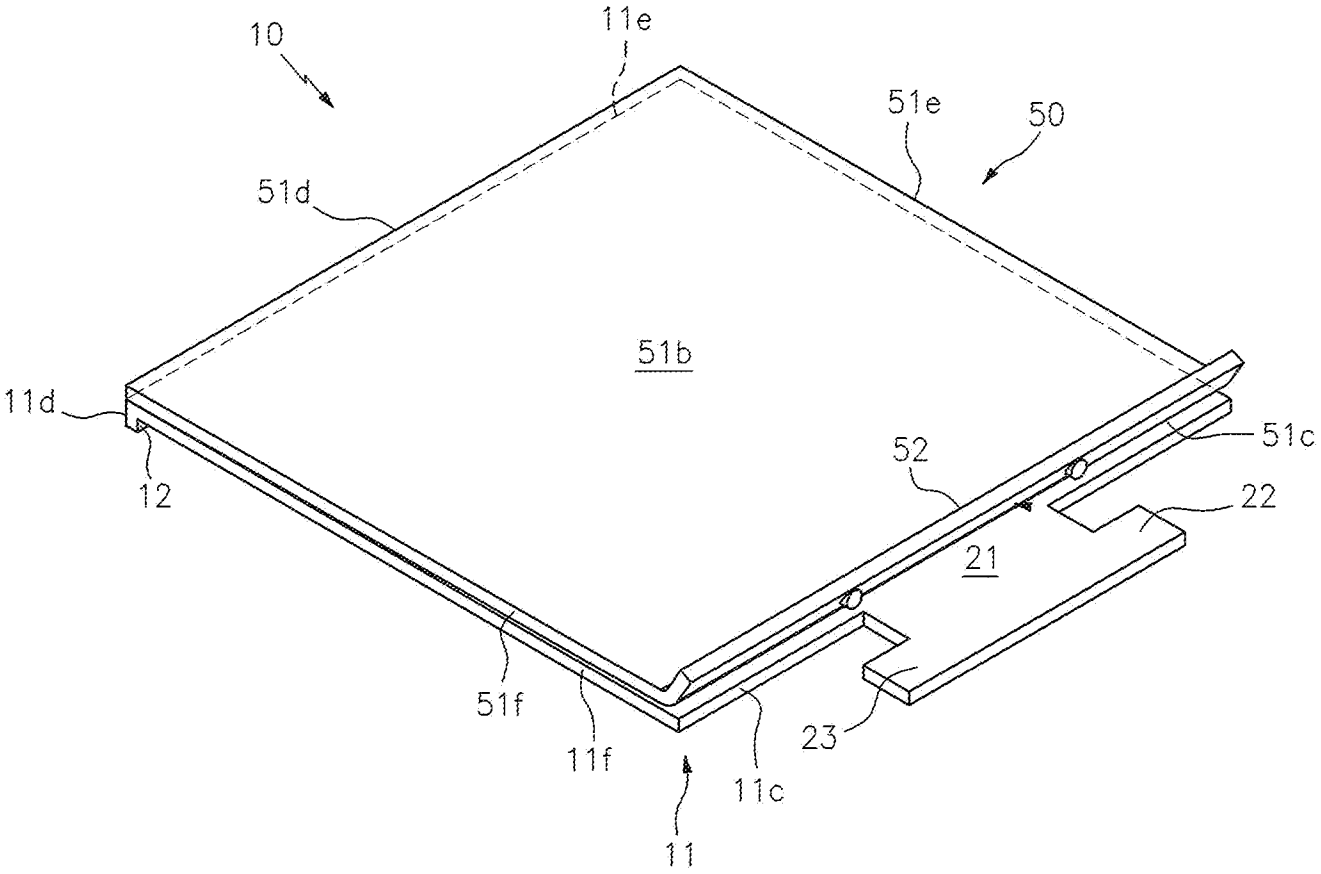
FIG. 5A is a perspective view of the portable desk, in accordance with yet another embodiment of the invention.
Figure 5B:
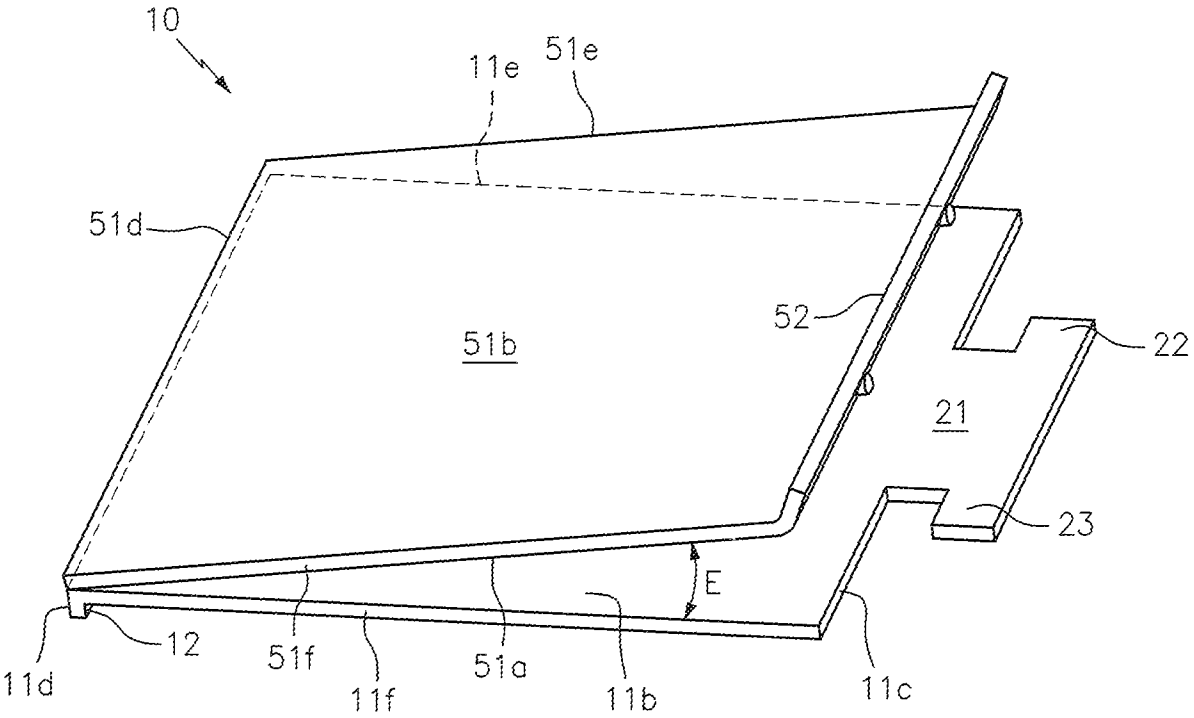
FIG. 5B is another perspective view of the portable desk, in accordance with another embodiment of the invention.
Figure 5C:
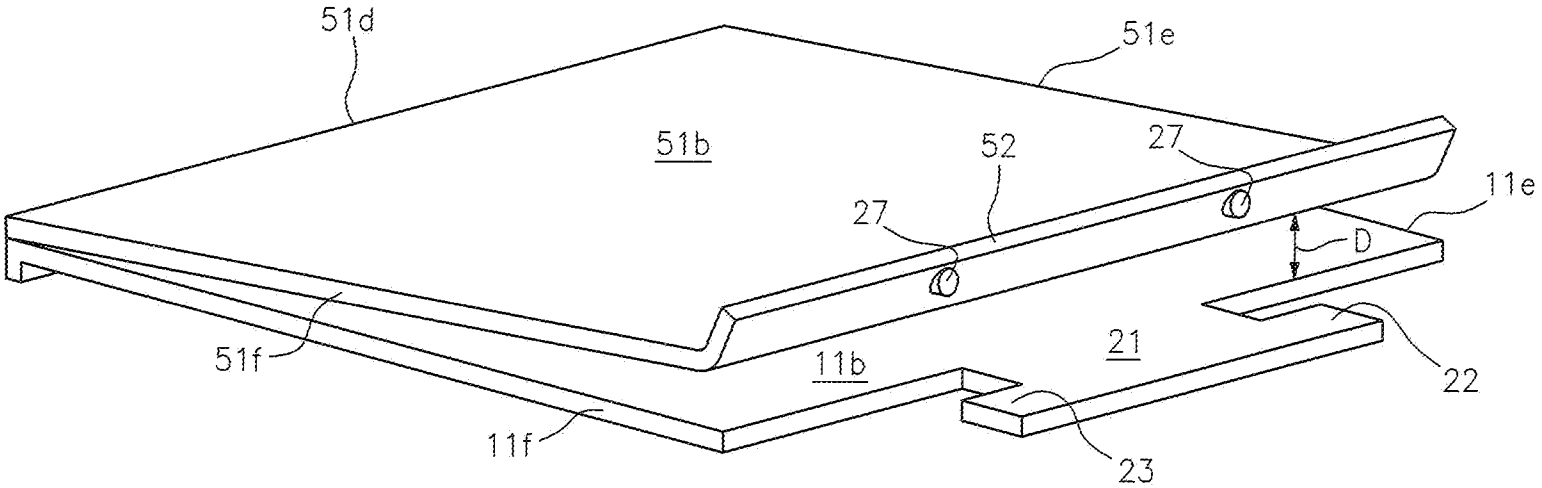
FIG. 5C is a front end view of the portable desk, in accordance with another embodiment of the invention.

FIGS. 5A-5C illustrate another embodiment of the portable desk 10, that further includes a second body section 50, having a top surface 51*a*, bottom surface 51*b*, a front end 51*c*, a back end 51*d*, and a pair of opposing sides 51*e* and 51*f*, respectively.

As shown, the second body 50 is positioned beneath the main body 11, to form a pocket area into which documents or other such devices can be placed and stored. As such, the top surface 51*a* is positioned against the bottom surface 11*b*, and the side surfaces 11*c*, 11*e* and 11*f* are adjacent to, and generally parallel with side sections 51*c*, 51*e* and 51*f*, respectively. In the present embodiment, the above described orthogonal walls 24 and 25 can be replaced with a single elongated orthogonal wall 52 that extends across the front end 51*c*. The wall 52 is arranged parallel with the protrusions 22 and 23, to form the pockets 26 described above.

In one embodiment, the second body can be constructed from a somewhat resilient material, and the back ends 11*d* and

51*d*, can be joined together. Such a feature allowing the bodies 11 and 50 to be separated/flex, so as to transition between the naturally closed position illustrated in FIG. 5A, and the open position illustrated in FIGS. 5B and 5C. Of course, the two bodies 11 and 50 can also be joined by any number of other objects such as a hinge or other forms of connectors (not illustrated).

In one embodiment, the second body section 50 can also be constructed from lightweight injection molded plastic, and will have a shape and dimension that is complementary to the shape and dimension of the main body 11. While this is not required in all embodiments, the use of a lightweight construction material, along with substantially identically shaped and sized components can substantially decrease manufacturing costs, and/or can allow the bodies 11 and 50 to be constructed as a single unitary element; however, other shapes and/or construction materials are also contemplated. As such, the device 10 can be sized and shaped so as to accommodate any number of different factors such as the size of the paper and/or articles intended to be sandwiched between the body members 11 and 50.

Accordingly, the above described portable desk 10 can function to provide a lightweight, inexpensive portable desk which can be utilized in conjunction with a travel suitcase and can be stored within the same when not in use.

As described herein, one or more elements of the portable desk 10 can be secured together utilizing any number of known attachment means such as, for example, screws, glue, compression fittings and welds, among others. Moreover, although the above embodiments have been described as including separate individual elements, the inventive concepts disclosed herein are not so limiting. To this end, one of skill in the art will recognize that one or more individual elements such as the main body 11, the engagement member 20, the wall 52, and/or the protrusions 22 and 23, for example, may be formed together as one continuous element, either through manufacturing processes, such as welding, casting, or molding, or through the use of a singular piece of material milled or machined with the aforementioned components forming identifiable sections thereof. As to a further description of the manner and use of the present invention, the same should be apparent from the above description. Accordingly, no further discussion relating to the manner of usage and operation will be provided.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A portable desk, comprising:

a main body having a generally planar top surface, a bottom surface, a front end, a back end, and a pair of opposing sides;

an engagement member that includes a central section having a first end that is in communication with the front end of the main body, and a second end extending linearly outward therefrom, and a first protrusion and a second protrusion, each of the protrusions being positioned adjacent to the second end of the central section, and extending outward in a parallel orientation with the front end of the main body; and one or more generally orthogonal walls that are positioned along the front end and back end of the main body wherein the one or more orthogonal walls positioned along the front end of the main body extend outward and downward beyond the bottom surface thereof and further comprises one or more non-slip pads that are disposed along each of the one or more downwardly extending generally orthogonal walls, and the one or more orthogonal walls positioned along the back end of the main body extend outward and upward beyond the top surface thereof, wherein said engagement member and each of the one or more generally orthogonal walls form first and second pockets that are configured to engage a pair of parallel rods disposed on a secondary object.

2. The portable desk of claim 1, wherein the engagement member comprises a generally T-shaped member.

3. The portable desk of claim 1, wherein the one or more generally orthogonal walls are arranged parallel to each of the first and second protrusions.

4. The portable desk of claim 1, wherein the engagement member includes a dimension that is suitable for passing between the parallel rods while oriented sideways.

5. The portable desk of claim 1, wherein the engagement member includes a dimension that is suitable for positioning the parallel rods within the pockets while oriented upright.

6. The portable desk of claim 1, wherein the central section includes a width between approximately 4 inches and 8 inches, said width being complementary to a separation distance of the parallel rods.

7. The portable desk of claim 1, wherein each of the pockets include a length of between approximately 0.25 inches and 2 inches, said length being complementary to a thickness of each of the parallel rods.

8. The portable desk of claim 1, further comprising:

a generally circular aperture that is disposed along the main body, said aperture extending from the top surface to the bottom surface, and being configured to function as a beverage holder.

9. The portable desk of claim 1, further comprising:

a hinge that is disposed along the main body so as to create a first body segment and a second body segment.

10. The portable desk of claim 9, wherein the hinge functions to allow the first body segment to fold approximately 180 degrees relative to the second body segment.

11. The portable desk of claim 9, wherein the hinge is positioned flush with the top surface of the main body.

12. The portable desk of claim 9, wherein the hinge is positioned along a central portion of the main body, and extends between the opposing sides, said hinge functioning to transition the device between an extended orientation and a folded orientation.

13. The portable desk of claim 12, wherein a length of the device is reduced by 50% when the device is in the folded orientation.

14. A portable desk, comprising:

a main body having a generally planar top surface, a bottom surface, a front end, a back end, and a pair of opposing sides and one or more orthogonal walls positioned along the back end of the main body extending outward and upward beyond the top surface thereof;

an engagement member that includes a central section having a first end that is in communication with the front end of the main body, and a second end extending linearly outward therefrom, and a first protrusion and a second protrusion, each of the protrusions being positioned adjacent to the second end of the central section, and extending outward in a parallel orientation with the front end of the main body;

a second body section having a shape and dimension that is complementary to a shape and dimension of the main body, said second body section including a generally planar top surface, a bottom surface, a front end, a back end, and a pair of opposing sides, wherein the second body section is positioned beneath the main body, and the back end of the main body is in communication with the back end of the second body section; and an elongated, generally orthogonal wall that is positioned along the front end of the second body section, said wall extending beyond the bottom surface thereof, and further comprises one or more non-slip pads that are disposed along the downwardly extending generally orthogonal wall, wherein said engagement member and the orthogonal wall forms a first and second pocket that are configured to engage a pair of parallel rods disposed on a secondary object.

15. The device of claim 14, wherein each of the main body and the second body section are constructed from a semi-rigid material, and are configured to flex relative to each other.

16. The portable desk of claim 14, wherein the engagement member includes a dimension that is suitable for passing between the parallel rods while oriented sideways, and the engagement member further includes a dimension that is suitable for positioning the parallel rods within the pockets while oriented upright.

* * * * *